US007500421B2

(12) United States Patent
Becker

(10) Patent No.: US 7,500,421 B2
(45) Date of Patent: Mar. 10, 2009

(54) MAGAZINE FOR AN AUTOMATIC SHELL FIRING WEAPON MOUNTED ON A GUN CARRIAGE

(75) Inventor: Wolfgang Becker, Vellmar (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 177 days.

(21) Appl. No.: 11/596,687

(22) PCT Filed: Apr. 28, 2005

(86) PCT No.: PCT/DE2005/000787

§ 371 (c)(1),
(2), (4) Date: Nov. 15, 2006

(87) PCT Pub. No.: WO2005/111527

PCT Pub. Date: Nov. 24, 2005

(65) Prior Publication Data

US 2008/0083322 A1 Apr. 10, 2008

(30) Foreign Application Priority Data

May 15, 2004 (DE) ..... 10 2004 024 302

(51) Int. Cl.
*F41A 9/61* (2006.01)

(52) U.S. Cl. ..... 89/33.14; 89/33.1; 89/33.16; 89/33.2; 89/33.25; 89/35.01; 42/49.01

(58) Field of Classification Search ..... 89/33.1, 89/33.14, 33.16, 33.2, 33.25, 35.01; 42/49.01
See application file for complete search history.

(56) References Cited

U.S. PATENT DOCUMENTS 2,252,227 A 8/1941 Haberlin
2,874,615 A * 2/1959 Kravik ..... 89/34
3,306,165 A * 2/1967 Christiansson ..... 89/33.1
3,333,507 A 8/1967 De Meiss
3,985,060 A 10/1976 Conley et al.
3,986,286 A * 10/1976 Stangel ..... 42/87
4,213,376 A 7/1980 Jackson
4,468,875 A * 9/1984 Harrison et al. ..... 42/50
4,658,700 A * 4/1987 Sullivan ..... 89/33.02
4,676,138 A * 6/1987 Thompson et al. ..... 89/33.14
4,719,839 A * 1/1988 Smothers et al. ..... 89/1.802
4,991,489 A * 2/1991 Lindberg ..... 89/6.5
5,131,315 A * 7/1992 Maher et al. ..... 89/45
5,147,972 A * 9/1992 Hagen et al. ..... 89/33.16
5,218,162 A * 6/1993 Bender-Zanoni ..... 89/33.02

(Continued)

*Primary Examiner*—Bret Hayes
*Assistant Examiner*—Michael D David
(74) *Attorney, Agent, or Firm*—Robert W. Becker; Robert W. Becker & Assoc.

(57) ABSTRACT

A magazine for an automatic shell-firing weapon mounted on a gun carriage, wherein the magazine is adapted to contain a belt and comprises two closed magazine portions interconnected by a closed transfer channel. The two magazine portions are disposed on opposite sides of the weapon. In a fully loaded state of the magazine, a front section of the belt is disposed in a first magazine portion disposed on a belt supply side of the weapon. The upper part of the first magazine portion has a removal opening that faces the weapon. A rear section of the belt is disposed in a second magazine portion on the opposite side of the weapon. A middle section of the belt is guided through the transfer channel.

11 Claims, 7 Drawing Sheets

U.S. PATENT DOCUMENTS 5,353,679 A * 10/1994 Nordmann ..... 89/34
5,594,192 A * 1/1997 Rodriguez ..... 89/33.16
5,628,137 A * 5/1997 Cortese ..... 42/105
5,684,265 A * 11/1997 Strasser et al. ..... 89/33.14
5,782,157 A 7/1998 Ellington et al.
5,905,224 A * 5/1999 Jordan ..... 89/33.02
6,257,115 B1 * 7/2001 Balsavage et al. ..... 89/33.1
6,272,967 B1 * 8/2001 Bender-Zanoni et al. ... 89/33.04
6,339,983 B1 * 1/2002 Mannhart ..... 89/33.16
6,345,562 B1 * 2/2002 Mannhart ..... 89/33.16
6,389,948 B1 * 5/2002 Beckmann ..... 89/33.17
6,405,629 B1 * 6/2002 Beckmann et al. ..... 89/33.17
7,159,504 B2 * 1/2007 Heldmann et al. ..... 89/45
2008/0047417 A1 * 2/2008 Grunewald ..... 89/33.1

* cited by examiner

MAGAZINE FOR AN AUTOMATIC SHELL FIRING WEAPON MOUNTED ON A GUN CARRIAGE

This specification for the instant application should be granted the priority date of May 15, 2004, the filing date of the corresponding German patent application 10 2004 024 302.6 as well as the priority date of Apr. 28, 2005, the filing date of the corresponding International patent application PCT/DE2005/000787.

BACKGROUND OF THE INVENTION

The specification incorporates by reference the disclosure of German priority document 10 2004 024 302.6 filed May 15, 2004 and PCT/DE2005/000787 filed Apr. 28, 2005.

The present invention is, of course, in no way restricted to the specific disclosure of the specification and drawings, but also encompasses any modifications within the scope of the appended claims.

The present invention relates to a belted magazine for an automatic shell firing weapon mounted on a gun carriage.

Magazines of the aforementioned kind are generally known. They are usually configured as an open magazine that is located on one side next to the weapon. That results in a disadvantageous distribution of weight and a large rotational diameter of the pivotable weapon. Furthermore, the ammunition is not protected from atmospheric influences and whipping of the belt can damage the shells.

It is an object of the invention to configure a magazine in such a way that an optimally balanced distribution of weight and a small rotational diameter are achieved. It should furthermore be possible to guide the belt in such a way that whipping is avoided.

SUMMARY OF THE INVENTION

This object is realized, according to the invention, by a magazine that is adapted to contain a belt that in turn is adapted to be withdrawn from the upper side of the magazine and supplied to the weapon, wherein the magazine comprises two closed magazine portions that are interconnected by a closed transfer channel, wherein the magazine is disposed on the front side of the gun carriage in such a way that the two magazine portions are disposed on opposite sides of the weapon and the belt is adapted to be disposed in the magazine such that in a fully loaded state of the magazine a front section of the belt, as viewed in the direction of withdrawal of the belt from the magazine, is adapted to be disposed in a first one of the magazine portions that is disposed on the belt supply side of the weapon, wherein an upper part of the first magazine portion is provided with a removal opening that faces the weapon, wherein a rear section of the belt is adapted to be disposed in a second one of the magazine portions that is disposed on an opposite side of the weapon, and wherein a middle section of the belt is adapted to be guided through the transfer channel that interconnects the first and second magazine portions.

It is a fundamental concept of the invention to configure the magazine in such a way that the ammunition is essentially distributed evenly on both sides of the weapon. This is achieved in that the magazine is comprised of two closed magazine portions that are connected to each other by means of a likewise closed transfer channel. The entire magazine is attached below the weapon in such a way that each of the two magazine portions is located on an opposite side of the weapon. Due to that configuration, the magazine requires only little space on the sides of the weapon and enables a reduction of the rotational contour. Since the magazine is closed except for a removal opening, a good protection against atmospheric influences is provided. In a particularly advantageous embodiment, special guide means in the interior of the magazine such as a guide plate, a separation bar, a guide claw and a glide film, which is cushioned for dampening purposes, prevent damaging of the individual shells when the belt is removed. The magazine according to the invention can furthermore be configured and positioned below the weapon in such a way that it doesn't block the viewing of target optics located below the weapon.

The attachment of the magazine can be realized in a simple manner by suspending and locking it in place.

BRIEF DESCRIPTION OF THE DRAWINGS

One exemplary embodiment for a magazine according to the invention is described in more detail below in conjunction with the attached drawings, in which.

DESCRIPTION OF SPECIFIC EMBODIMENTS

Figure 1:
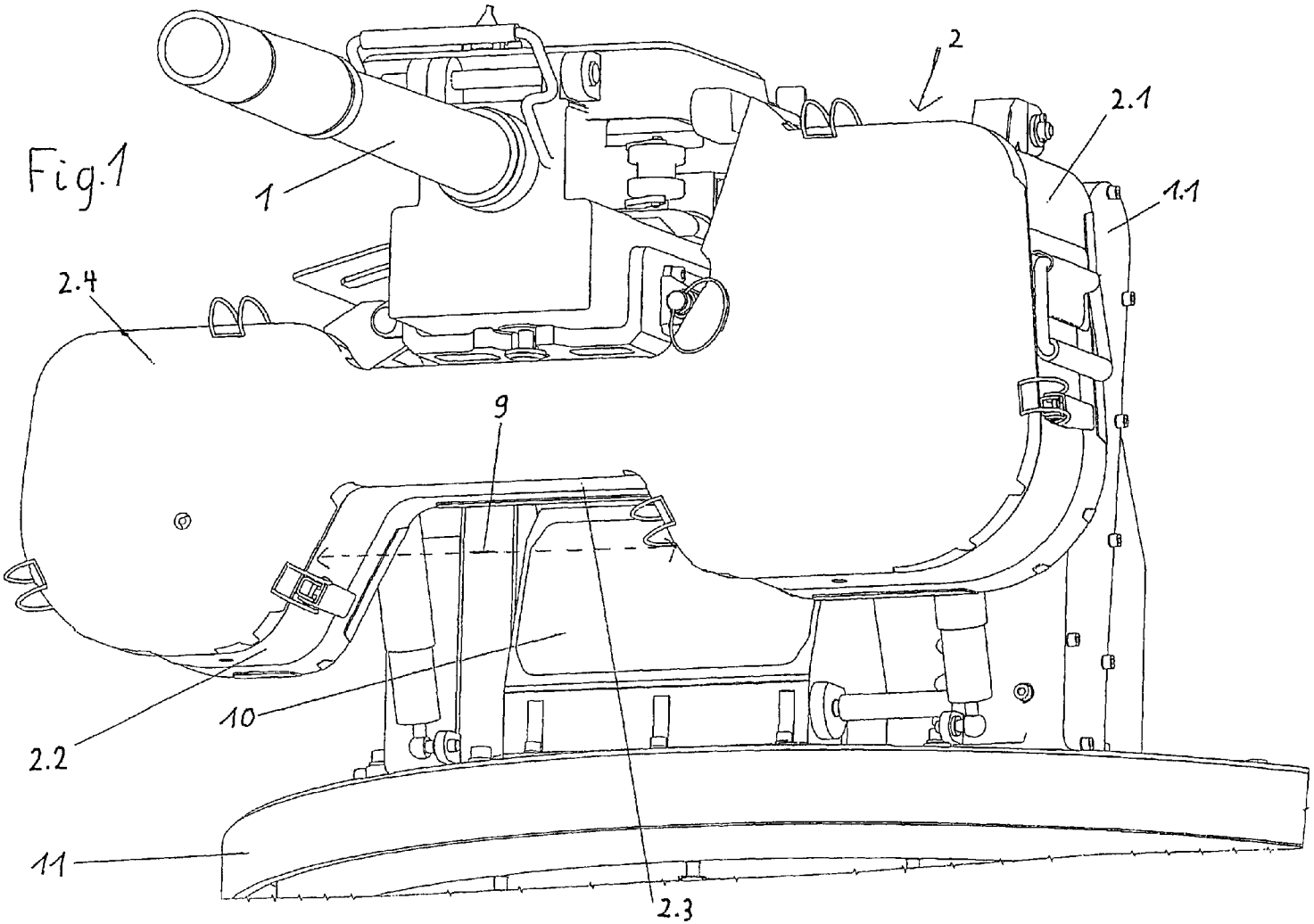
FIG. 1 shows, in a perspective representation, an automatic shell firing weapon mounted on a gun carriage that has a closed magazine located below the weapon.

FIG. 1 shows an automatic shell firing weapon 1, located on a base plate 11 and mounted on a gun carriage 1.1. A belted magazine 2 is attached to the gun carriage in the area in front of and below the weapon. The magazine 2 is comprised of two magazine portions 2.1 and 2.2 that are connected by means of a transfer channel 2.3. The magazine 2 is attached to the front side of the gun carriage 1.1 in such a way that the magazine portions 2.1 and 2.2 are located on opposite sides of the weapon 1.

The magazine 2 is configured as a closed magazine with a removable cover 2.4 that jointly covers the two magazine portions 2.1 and 2.2 and the transfer channel 2.3.

In the mounted condition according to FIG. 1, the magazine has a recess 9 in the area of the bottom wall of the transfer channel 2.3 between the magazine portions 2.1 and 2.2. The magazine 2 is attached to the gun carriage 1.1 in such a way that the transfer channel is located below the weapon tube and the recess 9 enables the target optics 10 located below the weapon to see through.

The magazine 2 and its manner of operating are described below in more detail with the aid of FIGS. 2 through 7.

Figure 3:
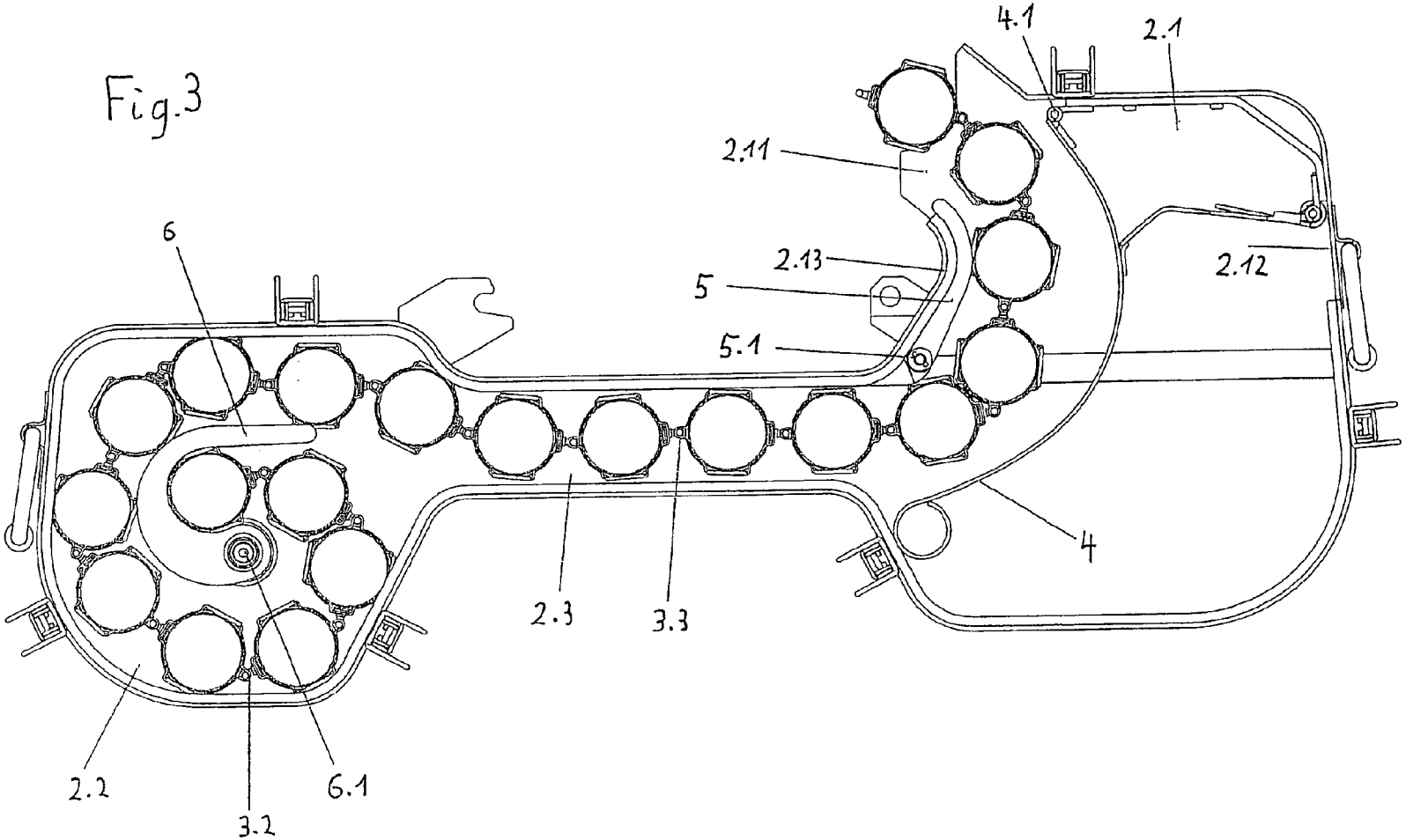
FIG. 3 shows the magazine in a representation analogous to FIG. 2, in an open, partially emptied state.

As can be seen in the drawings, the interior space of the first magazine portion 2.1 is connected to the interior space of the second magazine portion 2.2 by means of the transfer channel 2.3. The belt that carries the shells is introduced into the magazine 2 in such a way that, when the magazine is fully loaded, a front section 3.1 of the belt is situated in the first magazine portion 2.1, which is located on the belt supply side of the weapon 1. On the side facing the weapon 1, the first magazine portion 2.1 is provided with a removal opening 2.11 through which the belt can be withdrawn and supplied to the weapon. A second section 3.2 of the belt is located in the second magazine portion 2.2, and a middle section 3.3 of the belt, which connects the first section 3.1 and the second section 3.2, is guided from the second magazine portion 2.2 to the first magazine portion 2.1 through the transfer channel 2.3. The first section 3.1 of the belt is positioned in the first magazine portion 2.1 in a meander shaped manner. In order to avoid whipping of the belt when the first section 3.1 of the belt is withdrawn, the side wall 2.12 opposite the removal opening 2.11 of the first magazine portion 2.1 is provided with a guide plate 4 that supports and guides one side of the belt loops in the first magazine portion 2.1. The guide plate 4 extends from the lower part of the first magazine portion 2.1 upwardly to the removal opening 2.11 and can be swiveled about a swivel axis 4.1, which is located in the area of the removal opening 2.11, into the interior space of the first magazine portion 2.1. When the first magazine portion 2.1 is emptied by withdrawing the first section of the belt 3.1, the guide plate 4 is automatically guided inwardly by means of a spring element. In that manner, the guide plate 4 uninterruptedly supports the remaining shells 3.4 that are attached to the belt until it reaches a final position, represented in FIG. 3, in which it is arrested. FIG. 3 shows the magazine in the state in which the belt loops of the first section 3.1 are withdrawn from the first magazine portion 2.1 and the middle section 3.3 of the belt is guided through the first magazine portion 2.1 directly to the removal opening 2.11. The peripheries of the shells thereby rest against the guide plate 4, which has been swiveled inwardly.

Furthermore, a separating bar 5 for guiding the shells and the belt is located on the side wall 2.13 below the removal opening 2.11 of the first magazine portion 2.1. The separating bar 5 can be swiveled about a swivel axis 5.1, which is located on the side wall 2.13, toward that side wall. When the first magazine portion 2.1 is fully loaded, the separating bar 5 separates the last belt loop of the belt section 3.1, which is positioned in a meander shaped manner, from the belt section 3.3 that enters from the transfer channel 2.3. In that manner, it is avoided that shells lie directly on top of each other. When the first magazine portion 2.1 is emptied, the separating bar 5 automatically swivels into the position represented in FIG. 3 and is thereby converted into a guide means when the separating function in no longer required.

The second portion 3.2 of the belt is positioned in the second magazine portion 2.2 in a spiral shaped manner. A guide claw 6, disposed so as to be pivotable about a swivel axis 6.1 in the direction of retraction of the belt, extends around the end of the belt. The guide claw 6 supports the second section of the belt when it is unrolled from its spiral position and avoids jams.

Figure 4:
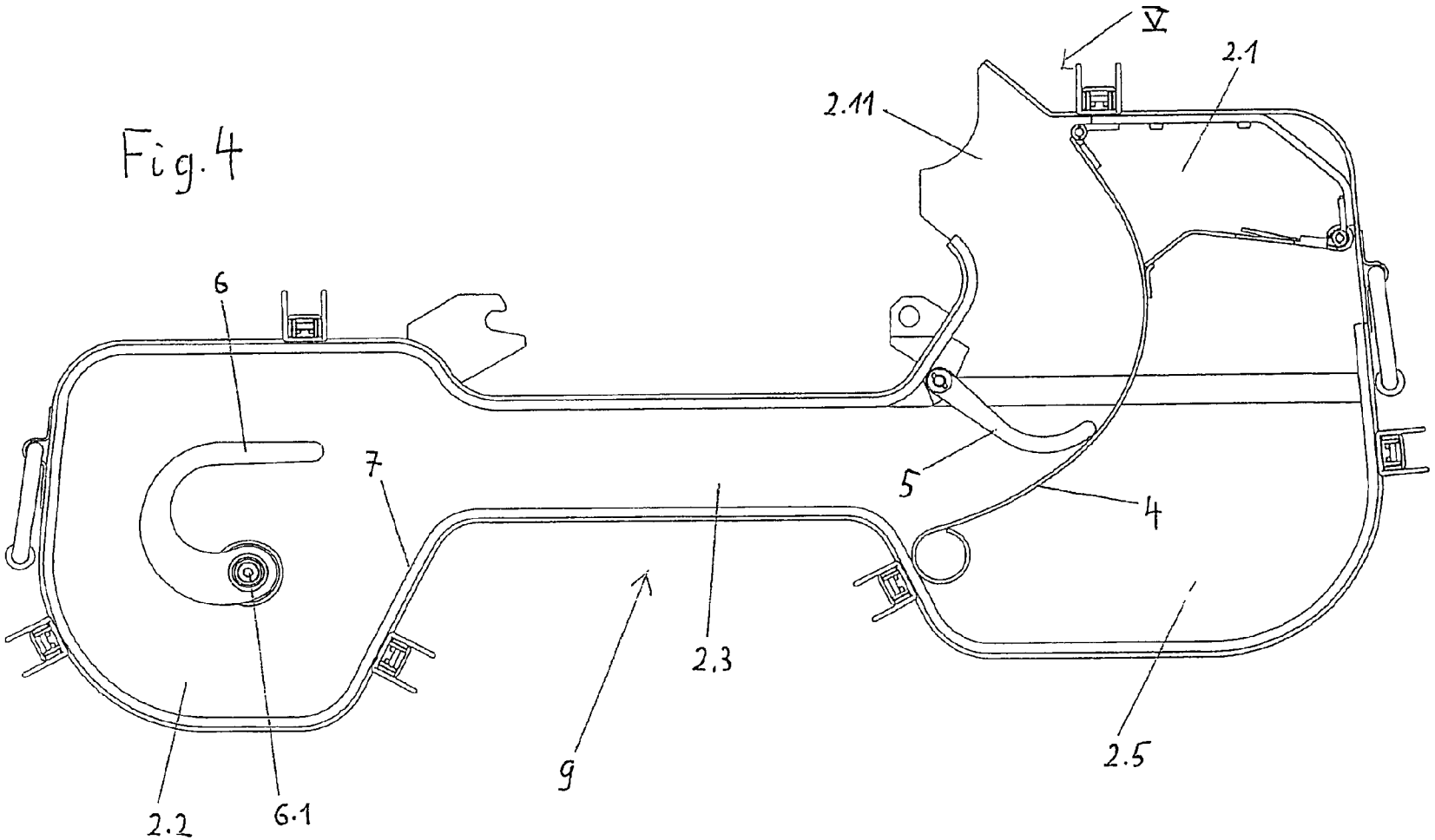
FIG. 4 shows the magazine in a representation analogous to FIG. 2 in an open, entirely emptied state.

As shown in particular in FIG. 4, the side walls of both magazine portions 2.1 and 2.2 and of the transfer channel 2.3 are provided with spacer beads 7 that project inwardly and extend in the direction of retraction of the belt. They serve for guiding the shells 3.4.

The bottom or base 2.5 of both magazine portions 2.1 and 2.2, of the transfer channel 2.3 and, if required, the inside of the cover 2.4 are lined with a cushioned glide film, so that the shells that are positioned in the magazine 2 in a direction perpendicular to the bottom 2.5 and to the cover 2.4 are guided easily and are not damaged.

Figure 5:
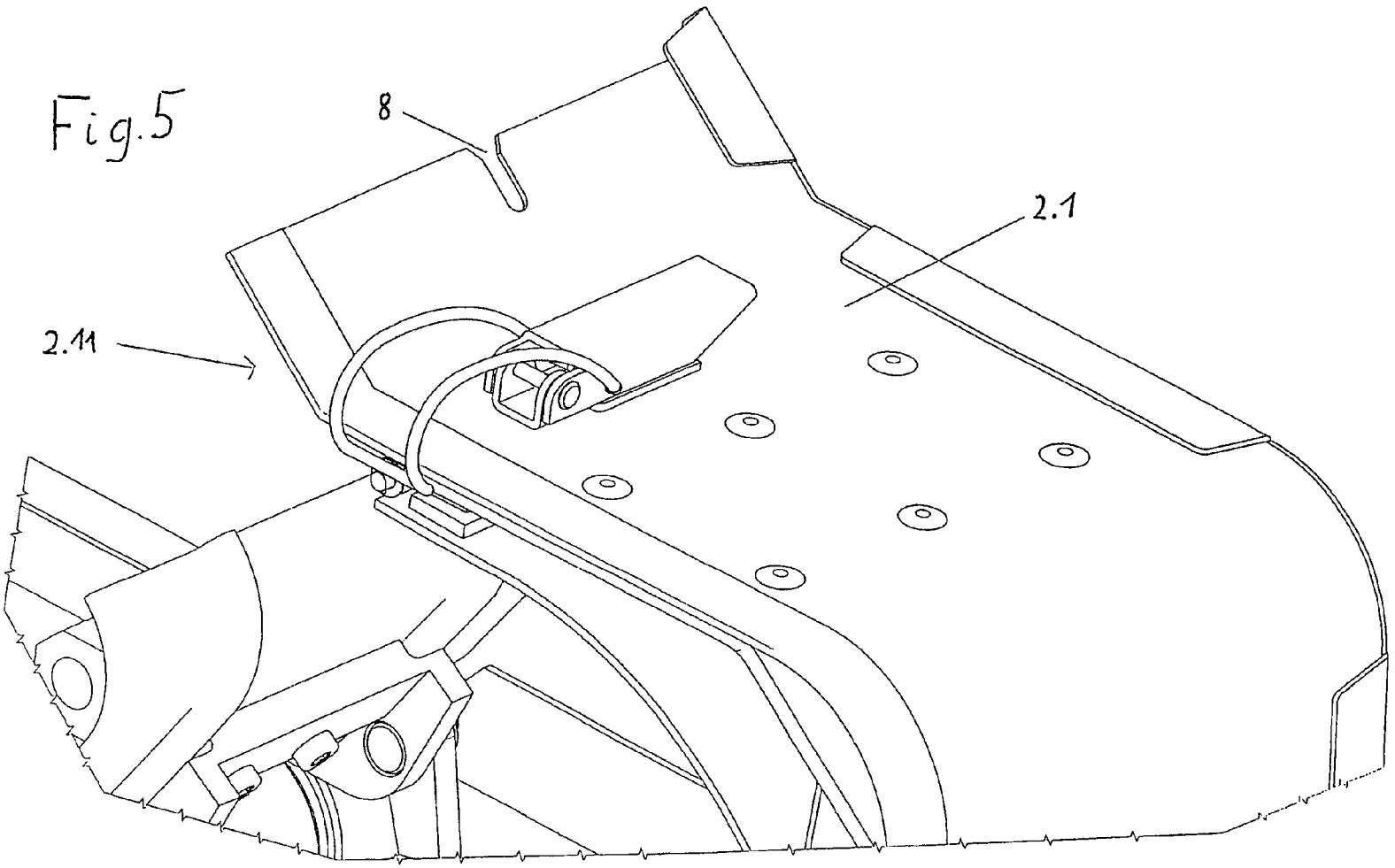
FIG. 5 shows a partial top view of the magazine, enlarged in relation to FIG. 4 and taken from the direction V in FIG. 4.
Figure 6:
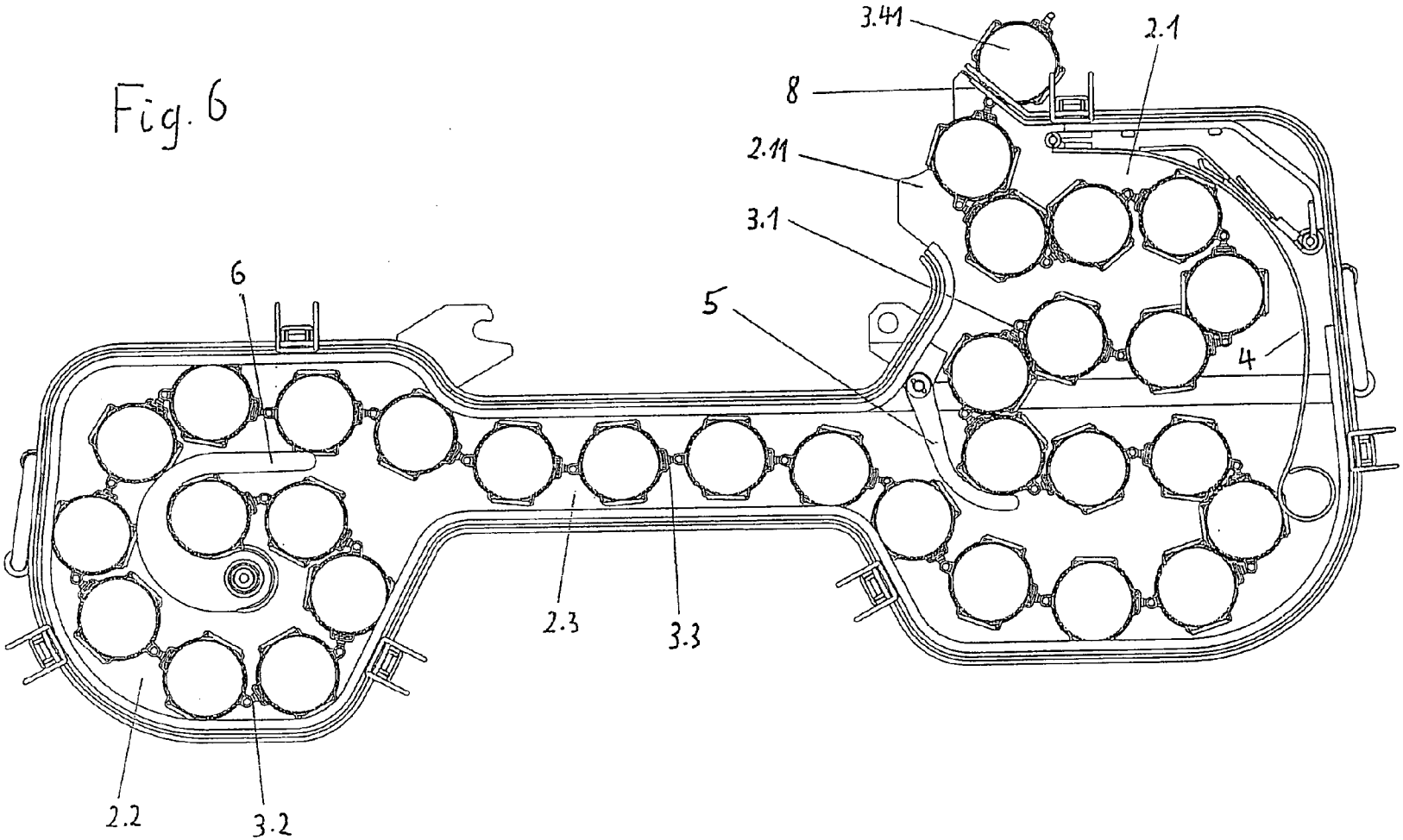
FIG. 6 shows the magazine in a representation analogous to FIG. 2 in an open and fully loaded state, whereby the first shell is drawn out and arrested.
Figure 7:
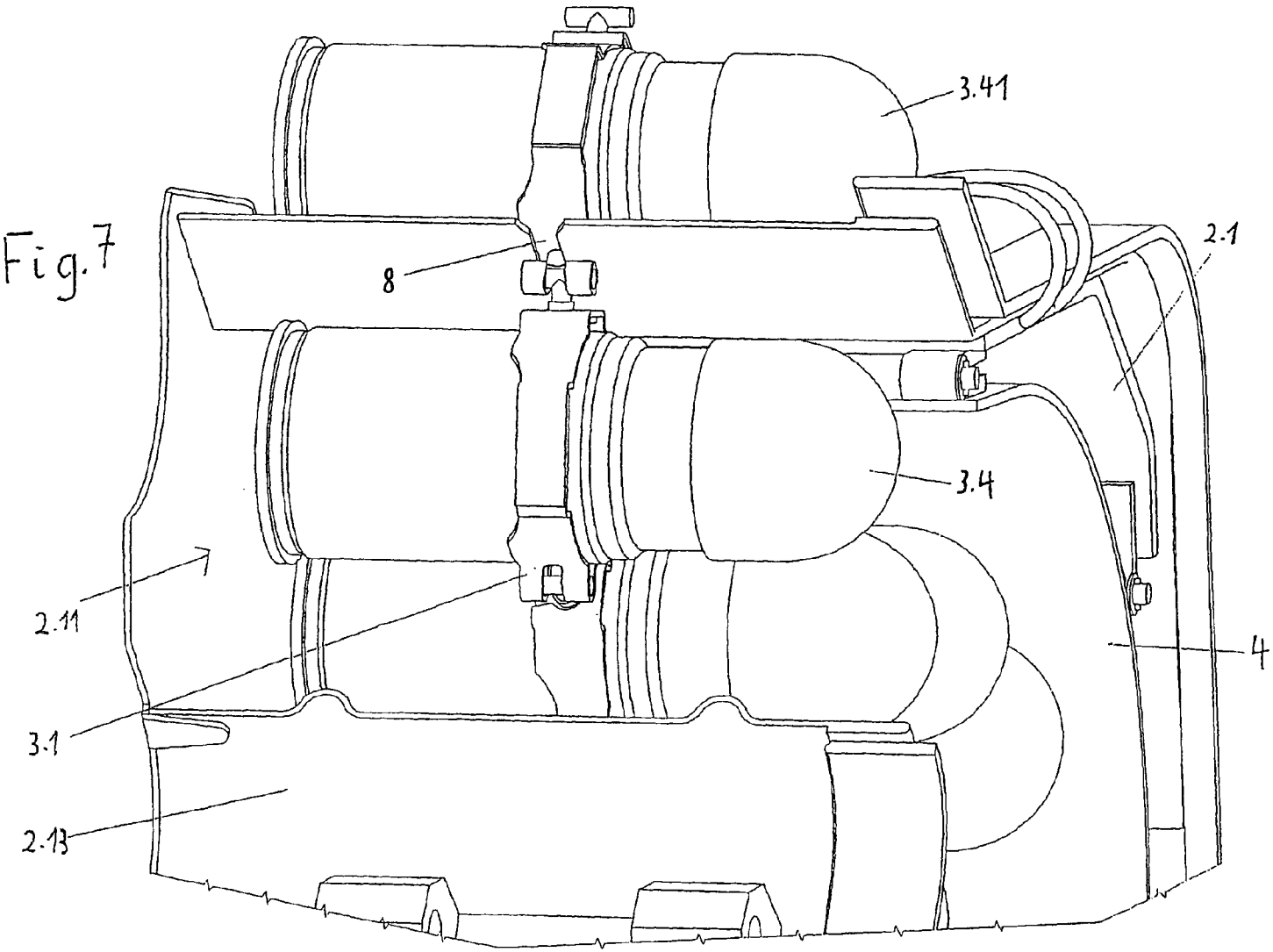
FIG. 7 shows the magazine in the area of the removal opening in a perspective, enlarged representation.

Behind the respectively first shell 3.41 that is positioned at the supply end, the belt can be suspended in a notch 8, represented in FIGS. 5 through 7, which is located in the upper side wall of the first magazine portion 2.1 on the edge of the removal opening 2.11. Therefore, when the belt is removed from the weapon 1 in the partially emptied state of the magazine, the belt does not fall back into the magazine such that the supply end of the belt would not be reachable any more. As can be viewed in FIGS. 6 and 7, the end of the belt is arrested on the removal opening 2.11 and cannot fall back into the magazine.

Figure 2:
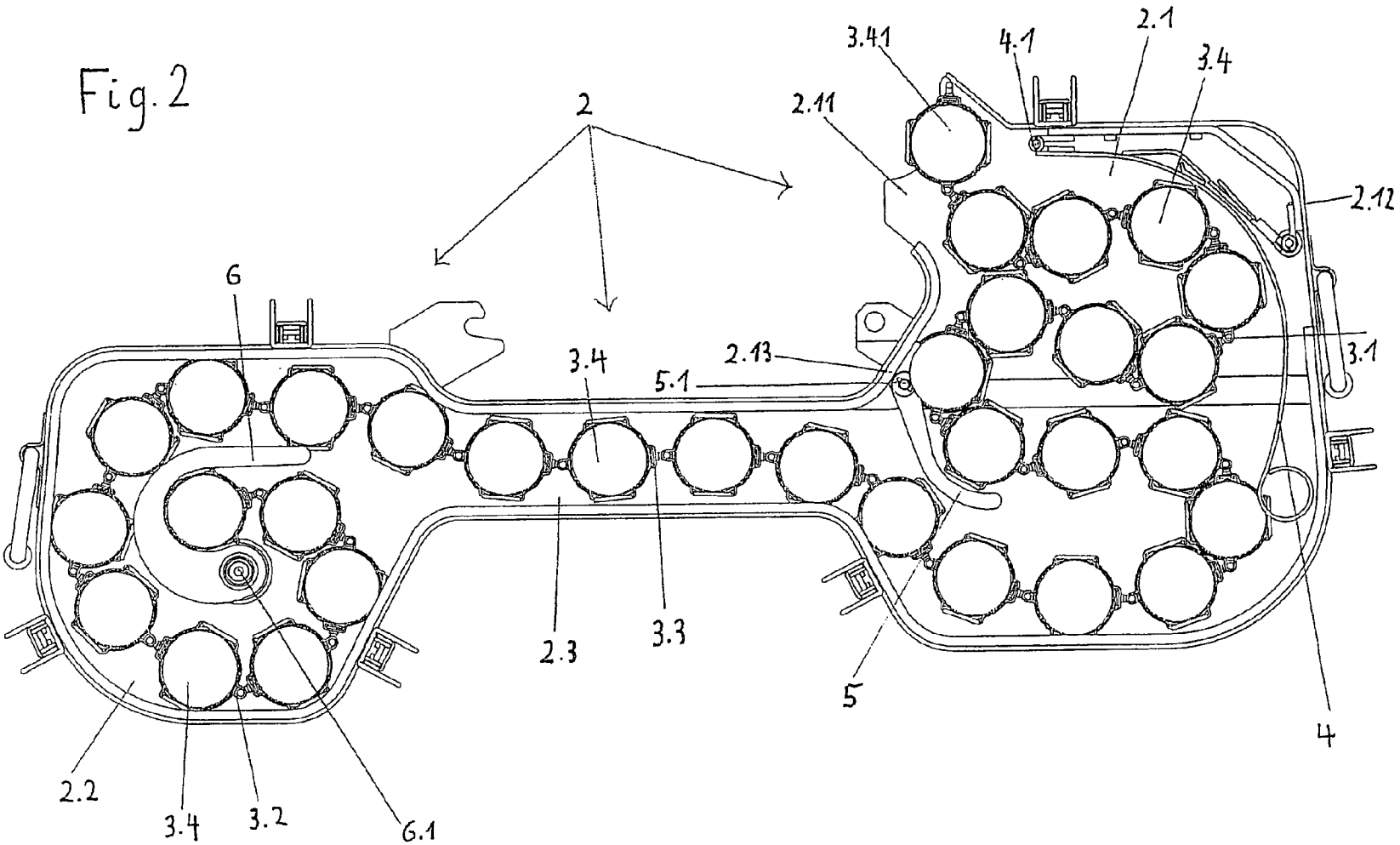
FIG. 2 shows a front view of the magazine analogous to FIG. 1 in an open, fully loaded state.

When the belt is supplied to the weapon 1, starting with the fully loaded state according to FIGS. 2 and 6, the belt is continually drawn out of the magazine 2. Initially, the section 3.1 of the belt that is positioned in the first magazine portion 2.1 in a meander shaped manner is withdrawn until the state represented in FIG. 3 is reached. Subsequently, the middle section 3.3 and the second section 3.2 of the belt from the second magazine portion 2.2 are drawn out through the transfer channel 2.3, until the magazine is emptied entirely, as represented in FIG. 4. With the cover 2.4 removed, the magazine 2 is reloaded with a new belt.

The invention claimed is:

1. A magazine for an automatic shell-firing weapon mounted on a gun carriage, wherein said magazine is adapted to contain a belt that is adapted to be withdrawn from an upper side of said magazine and supplied to the weapon, said magazine further comprising:

two closed magazine portions interconnected by a closed transfer channel, wherein said magazine is disposed on a front side of the gun carriage in such a way that said two magazine portions are disposed on opposite sides of the weapon and the belt is adapted to be disposed in said magazine such that in a fully loaded state of said magazine, a front section of the belt, as viewed in a direction of withdrawal of the belt from said magazine, is adapted to be disposed in a first one of said magazine portions that is disposed on a belt supply side of the weapon, wherein an upper part of said first magazine portion is provided with a removal opening that faces the weapon, wherein a rear section of the belt is adapted to be disposed in a second one of said magazine portions that is disposed on an opposite side of the weapon, wherein a middle section of the belt is adapted to be guided through said transfer channel that interconnects said first and second magazine portions, wherein said front section of the belt is adapted to be disposed in said first magazine portion in a meander shaped manner, wherein a guide plate is disposed on a first side wall of said first magazine portion located opposite said removal opening, wherein said guide plate is adapted to support and guide one side of loops of the belt in said first magazine portion, wherein said guide plate extends from a lower part of said first magazine portion to said removal opening, and wherein said guide plate is pivotable into an interior of said first magazine portion, about a pivot axis that is disposed in the vicinity of said removal opening , to an end position in which said middle section of the belt, when exiting said transfer channel, is adapted to be guided along said guide plate directly to said removal opening.

2. A magazine according to claim 1, wherein at least one removable cover is provided for closing off a front side of said magazine as viewed when said magazine is mounted on the gun carriage.

3. A magazine according to claim 2, wherein said at least one removable cover comprises a part that covers said first and second magazine portions and said transfer channel.

4. A magazine according to claim 1, wherein said first and second magazine portions and said transfer channel are dimensioned such that when said magazine is fully loaded with shells, the shells are distributed essentially evenly on both sides of the weapon.

5. A magazine according to claim 1, wherein when said first magazine portion is emptied, said guide plate is adapted to automatically pivot inwardly and to be arrested in said end position.

6. A magazine according to claim 1, wherein a separating bar is disposed in said first magazine portion on a second side wall thereof located below said removal opening, wherein said separating bar is pivotable toward said second side wall, wherein when said first magazine portion is fully loaded, said separating bar separates a last one of the loops of the front section of the belt from said middle section of the belt as it enters from said transfer channel and wherein in said end position of said guide plate, said separating bar rests against said second side wall below said removal opening and forms a belt guide.

7. A magazine according to claim 1, wherein said rear section of the belt is adapted to be disposed in said second magazine portion in a spiral shaped manner, wherein a guide claw is disposed in said second magazine portion, and wherein said guide claw extends about an end of the belt and is pivotable in a direction of withdrawal of the belt.

8. A magazine according to claim 1, wherein side walls of said two magazine portions and said transfer channel are provided with inwardly projecting spacer beads that extend in a direction of withdrawal of the belt, and wherein said spacer beads serve for guiding shells that are adapted to be loaded in said magazine.

9. A magazine according to claim 2, wherein a base of said two magazine portions, of said transfer channel, and/or of said at least one cover is lined with a cushioned glide film.

10. A magazine according to claim 1, wherein a notch for suspending a belt behind a respectively first shell held in the belt, is disposed on an edge of said removal opening in an upper side wall of said first magazine portion.

11. A magazine according to claim 1, wherein said magazine, on a lower side wall as viewed in a mounted state, and in a region of said transfer channel, is provided with a recessed area between said first and second magazine portions, and wherein said magazine is adapted to be mounted on the gun carriage in such a way that said transfer channel is disposed below a tube of the weapon and said recessed area provides a line of sight for target optics disposed below the weapon.

* * * * *